United States Patent [19]

Unger

[11] 4,435,882

[45] Mar. 13, 1984

[54] ASSEMBLY FOR HOLDING AND TENSIONING A WEBBING

[75] Inventor: Götz W. Unger, East Greenville, Pa.

[73] Assignee: Knoll International, Inc., New York, N.Y.

[21] Appl. No.: 503,075

[22] Filed: Jun. 13, 1983

Related U.S. Application Data

[63] Continuation of Ser. No. 311,637, Oct. 15, 1981, abandoned.

[51] Int. Cl.[3] ..... A44C 5/18; A44B 21/00; A44B 17/00

[52] U.S. Cl. ..... 24/265 R; 24/604; 24/629; 160/382; 24/683

[58] Field of Search ..... 24/201 R, 265, 361, 24/201 A, 202, 206 B, 211 R, 259 RC, 265 R, 265 C; 160/DIG. 15, 398, 382, 402, 404

[56] References Cited

U.S. PATENT DOCUMENTS

| | | | |
|---|---|---|---|
| 2,346,887 | 4/1944 | Winkier | 24/201 R |
| 2,845,671 | 8/1958 | Fisher et al. | 24/259 RC |
| 2,845,680 | 8/1958 | Elsner | 24/265 R |
| 3,067,475 | 12/1962 | Molla | 24/259 R |
| 3,710,422 | 1/1973 | van Halteren | 24/265 C |
| 4,193,413 | 3/1980 | Watts et al. | 24/201 A |

FOREIGN PATENT DOCUMENTS

| | | | |
|---|---|---|---|
| 582492 | 12/1976 | Switzerland | 24/201 R |

*Primary Examiner*—Gene Mancene
*Assistant Examiner*—James Hakomaki
*Attorney, Agent, or Firm*—Robert Scobey

[57] ABSTRACT

An assembly for holding and tensioning a webbing particularly useful in an article of furniture in which the webbing is adapted to be stressed by a person seated thereon. Male and female members are employed, the female member being fastened to a framework, and the male member being fastened to the webbing. The male member is positioned between side walls of the female member, and first and second abutment surfaces of each member engage each other in the assembly and are urged into engagement by the stress upon the webbing. The male member is levered into engagement with the female member.

7 Claims, 8 Drawing Figures

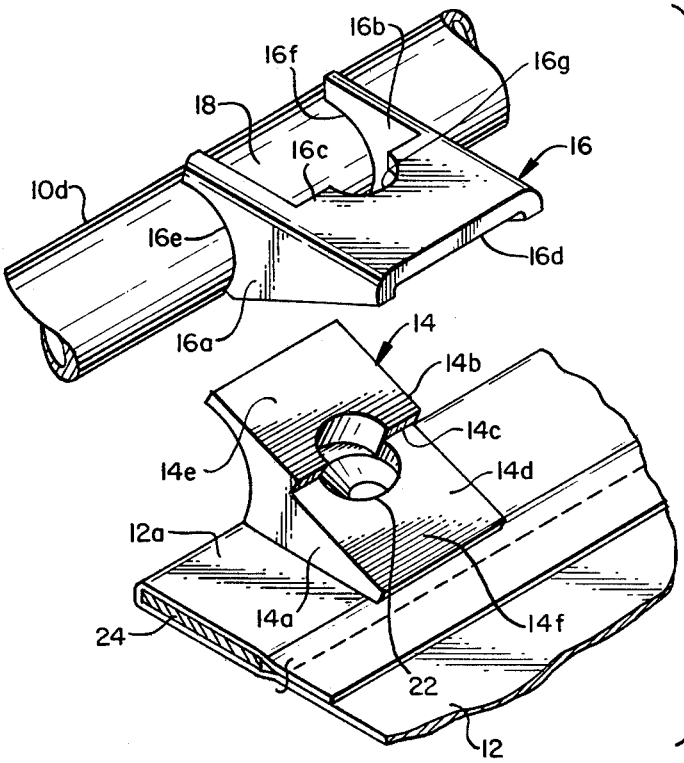
FIG. 3.
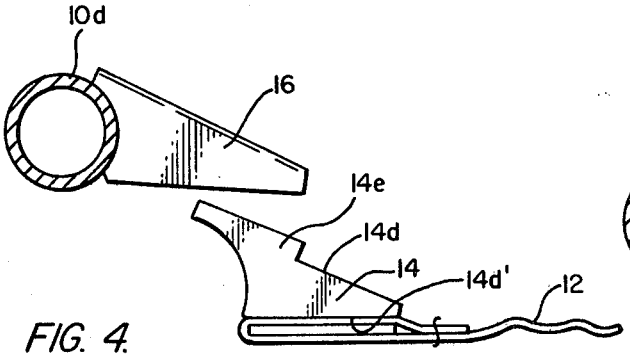
FIG. 4.
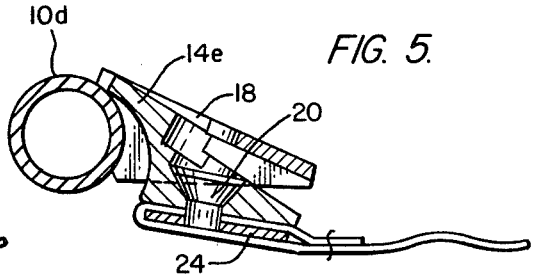
FIG. 5.
FIG. 6.
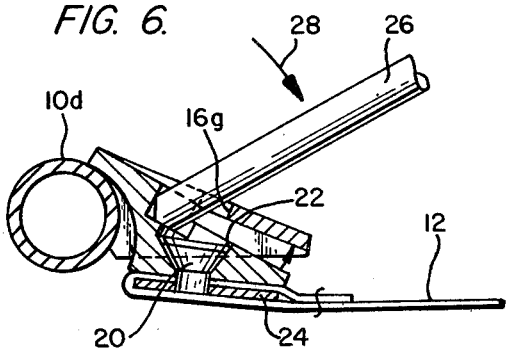
FIG. 7A.
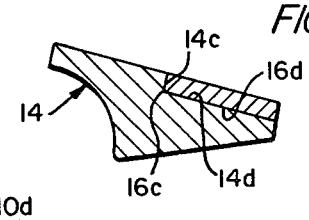
FIG. 7.
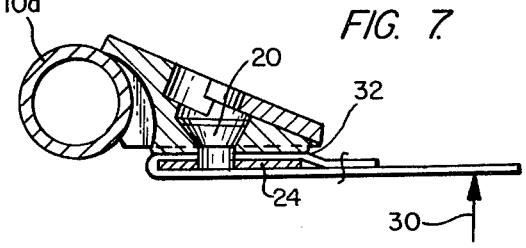

ASSEMBLY FOR HOLDING AND TENSIONING A WEBBING

BACKGROUND AND BRIEF DESCRIPTION OF THE INVENTION

This invention relates to an assembly for holding and tensioning a webbing, and has particular application to the furniture field to hold and tension webbing that is stressed by a person seated on the webbing.

Holding and tensioning devices are known, one of which is disclosed in Olsen U.S. Pat. No. 2,006,277 which issued June 25, 1935. The Olsen patent utilizes a bar which is secured to the edge of a webbing, and which is pulled beyond a socket so that it may be slipped into the socket to be held in place, holding and tensioning the webbing. One problem with this assembly is that the webbing must be stretched beyond its ultimate stretch in the completed article of furniture in order to position the bar within the holding socket.

The present invention overcomes this difficulty by utilizing male and female fastening members, in which the male member is levered into engagement with the female member without the need for stretching the webbing in excess of its final stretch in the completed article of furniture and without requiring the male member to be manipulated around (over and under) a socket as in the Olsen patent.

The following detailed description describes a representative and presently preferred embodiment of the invention.

BRIEF DESCRIPTION OF THE DRAWINGS

FIG. 3 is a perspective view of the male and female members constituting parts of the present invention, prior to being assembled together.

FIGS. 4 to 7A are views, some in section, showing the interengagement of the male and female members of FIG. 3 in holding and tensioning a webbing.

DETAILED DESCRIPTION

Figure 1:
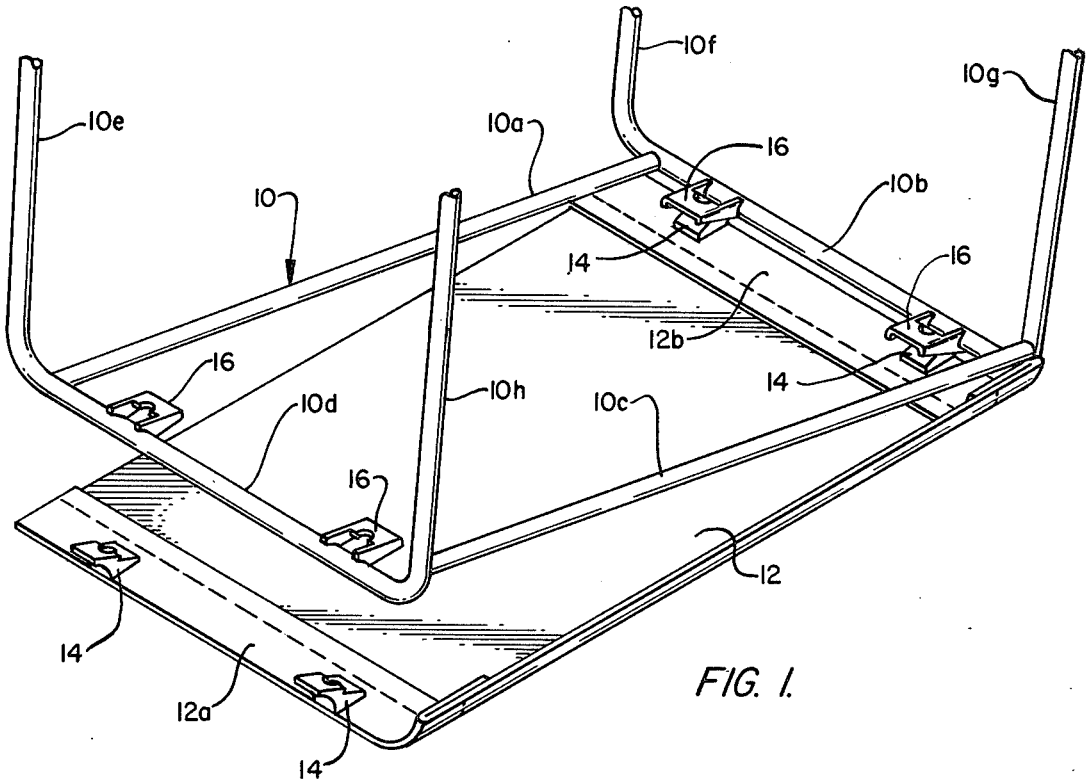
FIGS. 1 and 2 are perspective views showing the seat portion of a chair embodying the present invention.
Figure 2:
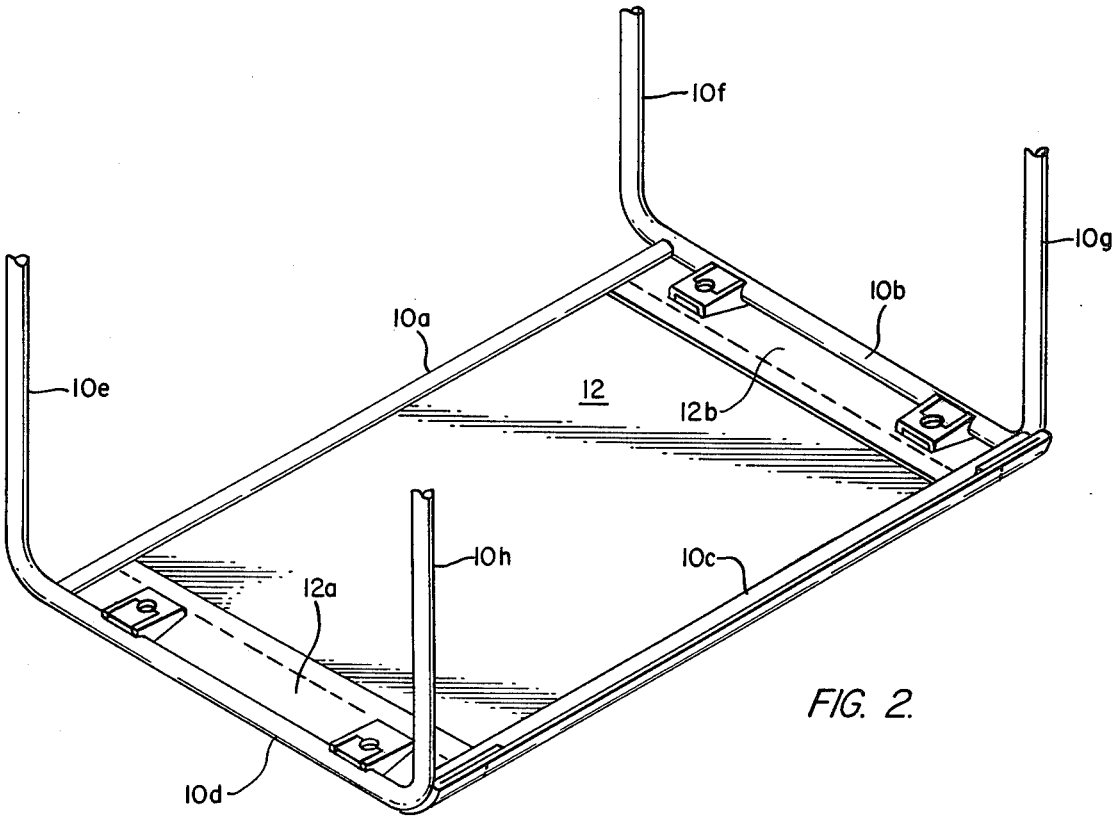

Referring to FIGS. 1 and 2, a tubular framework 10 is shown for a chair, in which rectangular portions 10*a*, 10*b*, 10*c*, and 10*d* define the framework of the chair seat, while frame portions 10*e*, 10*f*, 10*g* and 10*h* define the legs of the chair. A webbing 12 defines the seat of the chair, and includes opposed edge portions 12*a* and 12*b* which carry thereon male members 14 which are adapted to be engaged with female members 16 that are fastened to opposing seat frame pieces 10*b* and 10*d*. The male members 14 along one edge of the webbing 12 are engaged with the associated female members 16 on one seat frame portion, and the webbing 12 is then stretched and the opposed male members 14 are engaged with the associated female members 16, as will be described in more detail below, to form the completed seat assembly shown in FIG. 2.

FIG. 3 shows the details of the male and female members. Specifically, the female member 16 is formed with opposed side walls 16*a* and 16*b*, a first abutment surface 16*c* and a second abutment surface 16*d*, with these latter abutment surfaces perpendicular to each other and to the side walls 16*a* and 16*b*. The male member 14 is formed with opposed side walls 14*a* and 14*b*, a first abutment surface 14*c*, and a second abutment surface 14*d*, with these latter abutment surfaces perpendicular to each other and to the side walls 14*a* and 14*b*.

The female member 16 is advantageously attached to the frame member 10*d* by being spot welded thereto along curved surfaces 16*e* and 16*f* which engage the tubular frame section 10*d*. As thus held in position, it will be noted that the abutment surface 16*c* is spaced from and faces the frame portion 10*d* so as to leave a gap 18 therebetween.

The male member 14 is secured to the edge portion of the webbing 12, typically by being screw-fastened thereto through use of a screw 20 (FIGS. 5 to 7) that passes through a hole 22 in male member 14 and is threaded into a bar 24 that is secured inside a flap along the edge of the webbing 12. The webbing is thus attached to webbing attachment surface 14*d*′ which is opposed to and forms an acute angle with abutment surface 14*d* (FIG. 3). As is evident from FIG. 3, the webbing attachment surface 14*d*′ and the abutment surface 14*d* together constitute surfaces of a wedge-shaped portion of the male member 14.

When the male member 14 engages the female member 16, the respective abutment surfaces 14*c* and 16*c* engage each other, as do the respective abutment surfaces 14*d* and 16*d*. In assembled condition, the opposed walls 14*a* and 14*b* of the male member are positioned between the opposed walls 16*a* and 16*b* of the female member. It should be noted that the male member 14 includes a first step portion 14*e* (FIG. 3) that includes a surface (14*c*) that faces away from the frame portion 10*d* and constitutes the first abutment surface of that male member. This first step portion is positioned within the gap 18 noted above, i.e., the gap between the frame 10*d* and the abutment surface 16*c* of the female member 16. The second abutment surface (16*d*) of the female member, starting at its first abutment surface 16*c*, extends away from the frame portion 10*d*. The second abutment surface (14*d*) of the male member 14 which engages the second abutment surface 16*d* of the female member is defined by one of the surfaces of a second step portion 14*f* of the male member.

FIGS. 4 to 7 show how the male member is levered into engagement with the female member (assuming that the male and female members along the opposite edge of the webbing are already interengaged). The step portion 14*e* of the male member is positioned within the gap 18 (FIG. 5). Next, a lever 26, such as a screwdriver, is positioned with its tip portion bearing against a surface of the hole 22 in the male member 14. The lever bears against an edge of a cut-away portion 16*g* of the female member which registers with the hole 22 in the male member (FIG. 6). With the leverage thus applied, and the lever moved as shown by arrow 28 in FIG. 6, the webbing 12 is tensioned and the male member 14 is snapped into engagement with the female member 16 (FIG. 7). FIG. 7*a* is a sectional view, similar to that of FIG. 7, but not taken through the screw 20, showing the interengagement of the abutment surfaces 14*c*, 16*c* and 14*d* and 16*d* of the male and female members. A person sitting in the chair formed from the framework of FIGS. 1 and 2 will apply a seating stress against the webbing as shown by arrow 30 in FIG. 7. That stress tends to cause continued engagement of the male and female members 14 and 16. It will be noted from FIG. 7 that the tension in the webbing 12 acts at an angle to the plane of the abutment surfaces 14*d* and 16*d*, thus creating a moment that urges the abutment surfaces together.

It will be noted from FIGS. 4 to 7*a* that the webbing 12 does not have to be excessively stretched in order to cause engagement of the male member 14 with the female member 16. There is no moving of the male member over and around and then under a socket portion of the female member, as is necessary in the Olsen patent, cited above.

The invention thus provides a simple yet highly effective assembly for holding and tensioning a webbing. Any suitable number of male and female members may be included, spaced along opposed edges of a webbing, to hold and tension that webbing within a framework. As noted above, the male and female members along one of two opposed webbing edges are interengaged, and then the male members along the opposite webbing edge are levered into engagement with the associated female members. Disengagement of the male and female members is achieved by prying with the edge of a screwdriver or similar instrument at the location 32 shown in FIG. 7, i.e., pushing upwardly against the female member 16 and downwardly against the male member 14 to cause disengagement of the abutting surfaces 14*c*, 16*c* and 14*d*, 16*d*.

It will be appreciated that the presently preferred embodiment of the invention is subject to modification. Accordingly, the invention should be taken to be defined by the following claims.

I claim:

1. An assembly for holding and tensioning a webbing end to a framework comprising: a female member having opposed side walls; first and second abutment surfaces generally perpendicular to each other and disposed between said opposed side walls, said opposed side walls each having an edge portion; said female member being adapted to be fastened to a framework, in which said edge portions of the opposed side walls register with the framework; and a male member having opposed side walls and first and second abutment surfaces generally perpendicular to each other and disposed between the opposed side walls of said male member; said male member cooperating with said female member such that the first and second abutment surfaces of the male member are positioned respectively against the first and second abutment surfaces of the female member, and the opposed side walls of the male member are positioned between the opposed side walls of the female member; said male member including a portion thereof with a webbing attachment surface, opposed to and forming an acute angle with said second abutment surface of said male member.

2. An assembly as in claim 1, in which, in use, the first abutment surface of said female member is spaced from said framework to leave a gap therebetween, and said male member includes a first step portion positioned within said gap, said first step portion having a surface facing away from said framework that constitutes the first abutment surface of said male member.

3. An assembly as in claim 2, in which the second abutment surface of said female member, starting at said first abutment surface thereof, extends away from said framework, and the second abutment surface of said male member is defined by one of the surfaces of a second step portion constituting a part of said male member.

4. An article of furniture that includes an assembly as in claim 3, and a webbing attached to said webbing attachment surface and which is stressed by a person seated thereon, and in which the stress on said webbing urges the respective abutment surfaces of said male and female members against each other.

5. An article of furniture as in claim 4, in which said male member includes a hole in the first step portion thereof providing a surface against which leverage may be applied to bring said male and female members into engagement.

6. An article of furniture as in claim 5, in which said female member includes a cut-away portion thereof registering with the hole in said first step portion of said male member.

7. An assembly as in claim 1, in which said webbing attachment surface and said second abutment surface of said male member together constitute surfaces of a wedge-shaped portion of said male member.

* * * * *